US007046205B2

(12) United States Patent
Tamez

(10) Patent No.: US 7,046,205 B2
(45) Date of Patent: May 16, 2006

(54) SPRING-LOADED EXTENDIBLE ANTENNA FOR A MOBILE PHONE

(76) Inventor: Daniel C. Tamez, 6900 Preston Rd. #2323, Plano, TX (US) 75024

( * ) Notice: Subject to any disclaimer, the term of this patent is extended or adjusted under 35 U.S.C. 154(b) by 0 days.

(21) Appl. No.: 10/968,374

(22) Filed: Oct. 19, 2004

(65) Prior Publication Data

US 2006/0082507 A1 Apr. 20, 2006

(51) Int. Cl.
*H01Q 1/24* (2006.01)

(52) U.S. Cl. ..... 343/702; 455/575; 455/90

(58) Field of Classification Search ..... 343/702; 455/90, 550, 575
See application file for complete search history.

(56) References Cited

U.S. PATENT DOCUMENTS 4,471,493 A 9/1984 Schober ..... 455/90
5,321,738 A 6/1994 Ha ..... 379/61
5,983,119 A 11/1999 Martin et al. ..... 455/575
6,073,027 A 6/2000 Norman et al. ..... 455/550
6,091,972 A * 7/2000 Ogasawara ..... 455/575.7
6,239,754 B1 5/2001 Kim ..... 343/702
6,249,672 B1 * 6/2001 Castiel ..... 455/575.4
6,337,671 B1 1/2002 Lee ..... 343/901
6,744,624 B1 * 6/2004 Siddiqui ..... 361/683

* cited by examiner

*Primary Examiner*—Hoang V. Nguyen
(74) *Attorney, Agent, or Firm*—Michael L. Diaz

(57) ABSTRACT

The present invention is a spring-loaded manually extendable antenna for a mobile phone. An antenna extension system includes an extendable antenna stowed within an antenna housing. Within the antenna housing is a compressible spring. Attached to the bottom end of the antenna is a washer. The antenna is held in a stowed position by a manual release mechanism. When a mobile phone user desires, the manual release mechanism is depressed, which allows the antenna to be manually driven upward by the spring. The antenna is then extended to the extended position.

20 Claims, 3 Drawing Sheets

SPRING-LOADED EXTENDIBLE ANTENNA FOR A MOBILE PHONE

BACKGROUND OF THE INVENTION

1. Field of the Invention

This invention relates to mobile phones. Specifically, the present invention relates to a spring-load extendible antenna for a mobile phone.

2. Description of the Related Art

The use of mobile phones has increased tremendously over the past few years. The structure and capabilities of mobile phones have also correspondingly changed with the increased use of the mobile phones. In addition, because of the popularity and convenience of mobile phones, one can observe many people communicating on their mobile phones while simultaneously engaging in different types of activities. Driving is one such activity. Frequently, the driver attempts to use the mobile phone while simultaneously driving. Recent studies suggest an increase in accidents attributed to increased mobile phone usage while driving.

In addition to driving, there are numerous other situations where a person is simultaneously using a mobile phone while performing other activities. Such activities may include outdoor activities (i.e., visiting a park, hiking, golfing), traveling, shopping or caring for a child, etc.

There have been developed many devices, which make the use of the mobile phone far more convenient. One such type of device uses hands-free features such as earphones with integrated microphones. This device frees up a person's hands when using the mobile phone. In addition, many mobile phones incorporate a voice-activated dialer to allow a person to audibly command the dialing of a phone number. Such devices are extremely helpful in allowing a mobile phone user to more conveniently use their phones.

However, there are many mobile phones, which require the extension of an antenna. With the limited range of base stations communicating with mobile phones in a wireless telecommunications network, the extension of an antenna is sometimes necessary for proper use of the mobile phone. Although there are many hands-free devices available to assist the mobile phone user, there is no device which manually allows a mobile phone user to fully extend antenna by depressing a button or switch. A device for attachment to a mobile phone is needed which allows the manual extension of the mobile phone's antenna.

Although there are no known prior art teachings of an apparatus or system such as that disclosed herein, prior art references that discuss subject matter that bears some relation to matters discussed herein are U.S. Pat. No. 6,073,027 to Norman et al. (Norman), U.S. Pat. No. 6,239,754 to Kim (Kim), and U.S. Pat. No. 6,337,671 to Lee (Lee).

Norman discloses a portable phone having a housing with a slidable cover. An antenna is incorporated within the cover of the mobile phone. Upon sliding the cover out from its stowed position, the antenna is correspondingly extended. However, Norman suffers from the disadvantage of only being usable with a mobile phone with a slidable cover. Norman does not teach or suggest a manually extendable antenna, which is deployed from the casing of the mobile phone and is useable on any type of mobile phone housing.

Kim discloses a mechanism for extending and retracting an antenna in a mobile phone. A driving motor is engaged with a pulley system to raise and lower an antenna. Kim discloses a highly complex and costly system to drive a power antenna. Kim does not teach or suggest a manually deployed spring-activated antenna.

Lee discloses a power antenna for automatically extracting and retracting an antenna. A motor is used to generate a rotational force. A rotary member is installed in an antenna housing and is rotated by the motor. A coil spring is rotatably accommodated in the antenna house. Lee also discloses a complex motorized antenna raising system. Lee does not teach or suggest a spring-loaded extendible antenna which does not require a motor or complex gearing system.

Currently, there are no manual mechanisms to extend an antenna fully by merely depressing a release mechanism. To raise an antenna of a mobile phone, the user must perform two or more actions. The user must use two hands, one to hold the mobile phone and the other to manually raise the antenna. Obviously, if the user only has one hand to use, this action is unacceptable. Alternatively, the user can hold the mobile phone with one hand and pull the antenna out with the user's teeth. This way is also not desirable. An apparatus is needed which enables a user to manually extend an antenna without costly motors or gearing systems.

Thus, it would be a distinct advantage to have an easily extendable antenna for a mobile phone without costly items such as motors or gearing systems. It is an object of the present invention to provide such an apparatus.

SUMMARY OF THE INVENTION

In one aspect, the present invention is an antenna extension system for a portable wireless communication device such as a mobile phone. The antenna extension system includes an antenna housing affixed to the communication device. The antenna housing has a bore with an antenna slidably positioned within the bore of the antenna housing. A compressible spring is located within the antenna housing. A manual release mechanism holds the antenna within the antenna housing when the antenna is in the stowed position. The manual release mechanism selectively releases the antenna. When the manual release mechanism releases the antenna, the antenna is driven upward by the compressible spring to an extended position. In one embodiment, the manual release mechanism includes a rocker arm having an engagement end for engaging an outer surface of the antenna. In addition, the antenna includes an annular indentation located at a position upon the antenna that when the engagement end engages the outer surface of the antenna, the antenna is held in a stowed position. The manual release mechanism also may include a release button located on an exterior surface of the antenna housing. When the release button is depressed, the antenna is released and allowed to fully extend from the antenna housing.

In another aspect, the present invention is a mobile phone having an antenna extension system. The mobile phone includes a mobile phone casing which has an antenna housing affixed to the mobile phone. The antenna housing has a bore with an antenna slidably positioned within the bore of the antenna housing. A compressible spring is located within the antenna housing. A manual release mechanism holds the antenna within the antenna housing when the antenna is in the stowed position. The manual release mechanism may selectively release the antenna. When the manual release mechanism releases the antenna, the antenna is driven upward by the compressible spring to an extended position.

DESCRIPTION OF THE INVENTION

Figure 1:
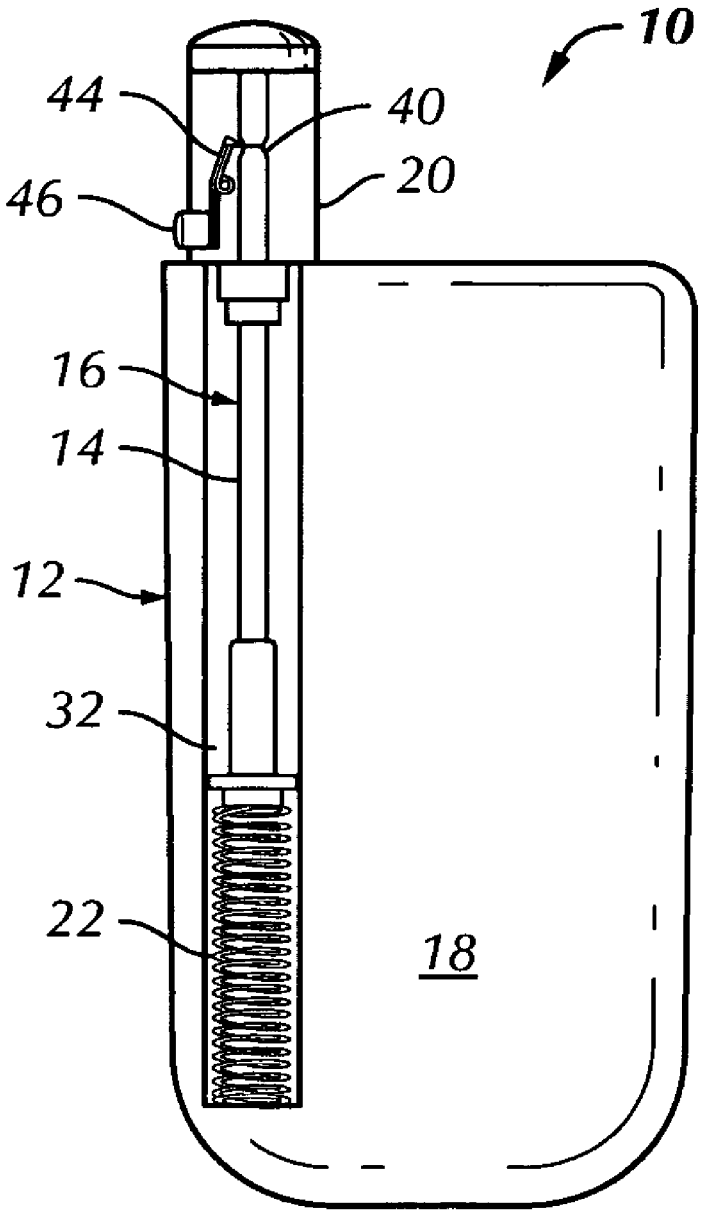
FIG. 1 is a rear view of a mobile phone incorporating an antenna extension system with an antenna in a stowed position in the preferred embodiment of the present invention.

A manually deployed spring-loaded extendable antenna for a mobile phone is disclosed. FIG. 1 is a rear view of a mobile phone 10 incorporating an antenna extension system 12 with an antenna 14 in a stowed position in the preferred embodiment of the present invention. The antenna extension system 12 includes the extendable antenna 14 slidably located within a hollow antenna housing 16 mounted in a portion of a mobile phone main structure 18. The antenna extension system also includes a manual release mechanism 20 and a spring 22. The manual release mechanism is preferably located on an exterior surface of the antenna housing, however, in alternate embodiments of the present invention, the manual release mechanism may be located anywhere upon the mobile phone. It should be understood that although the invention is exemplified in a mobile phone, the present invention may be utilized with any portable wireless communication device utilizing an antenna, such as a personal data assistant (PDA).

Figure 2:
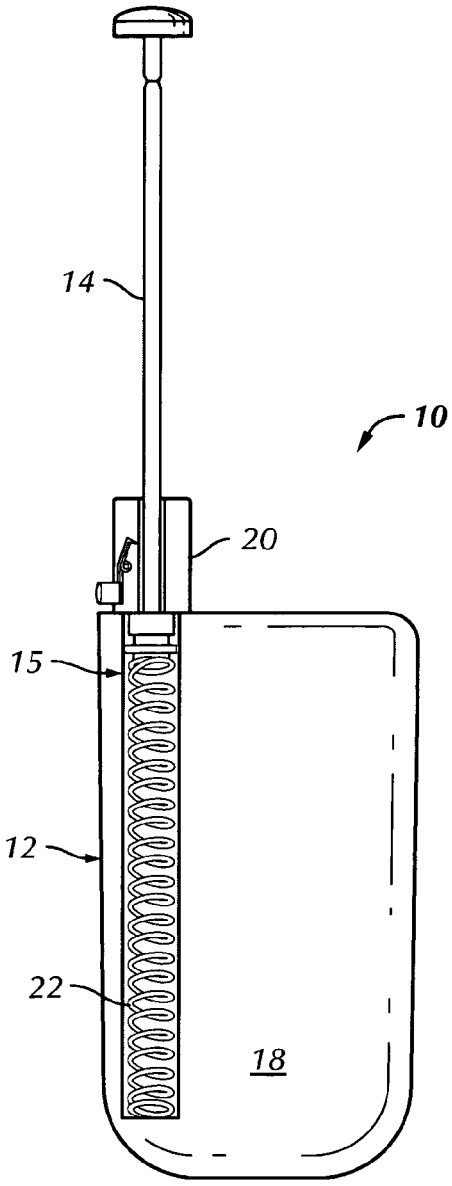
FIG. 2 is a rear view of the mobile phone incorporating the antenna extension system with the antenna in an extended position in the preferred embodiment of the present invention.

FIG. 2 is a rear view of the mobile phone 10 incorporating the antenna extension system 12 with the antenna 14 in an extended position in the preferred embodiment of the present invention. The spring 22 is biased to an upward position. As shown in FIG. 1, the antenna is held in the stowed configuration by the manual release mechanism 20. Upon activation of the manual release mechanism, the antenna is driven upward by the biased spring 22. The spring drives the antenna to the extended position illustrated in FIG. 3. To allow the antenna to move freely within the antenna housing, in the preferred embodiment of the present invention, the antenna housing is constructed of a rigid or substantially rigid material. However, the antenna housing may alternatively be flexible.

Figure 3:
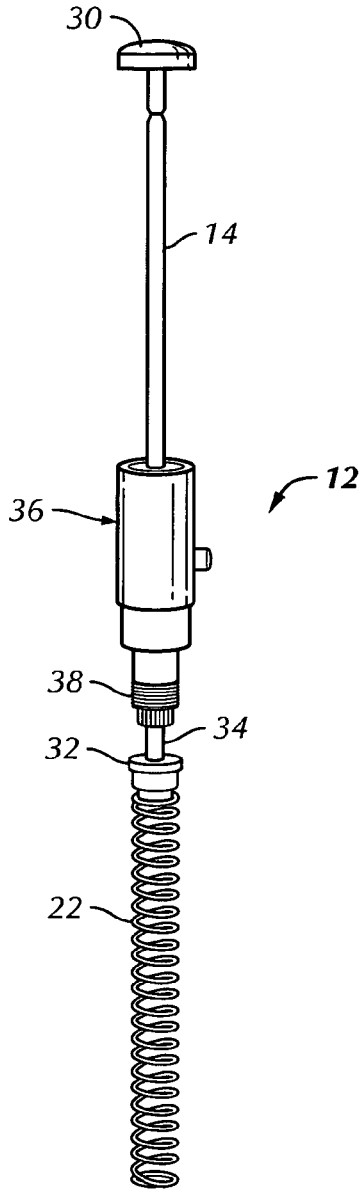
FIG. 3 is a front perspective view of the antenna extension system of FIG. 2 removed from the antenna housing.

FIG. 3 is a front perspective view of the antenna extension system 12 of FIG. 2 removed from the antenna housing. As illustrated in FIG. 3, the antenna is in the extended position. At the top end of the antenna is a conventional antenna cap 30. On an opposite end of the antenna is the spring 22. The spring is shown in an extended position. As is common with a conventional coil spring, the spring has a natural bias to an extended length. However, such springs may be compressed into a smaller length (as shown in FIG. 1). Preferably, the spring is a coil spring which is sized and shaped to fit below the antenna within the antenna housing. Upon the bottom end of the antenna is preferably attached a fixed washer 32. The washer 32 may include an opening 34 which is sized to fit about the outer surface of the antenna. The washer stays affixed to the bottom end of the antenna. The washer may include a surface area allowing a glue or adhesive compound to be affixed to an upper portion of the spring. Although a washer is depicted in FIG. 3, any structure or mechanism may be used to bridge the spring and the antenna. Alternatively, the antenna may be directly affixed to the spring. A conventional antenna coupling mechanism 36 is preferably located on the top of the antenna housing 16 and the top portion of the mobile phone main structure 18. The coupling mechanism preferably includes a threaded end 38 for attachment to the top portion of the mobile phone main structure 18.

Figure 4:
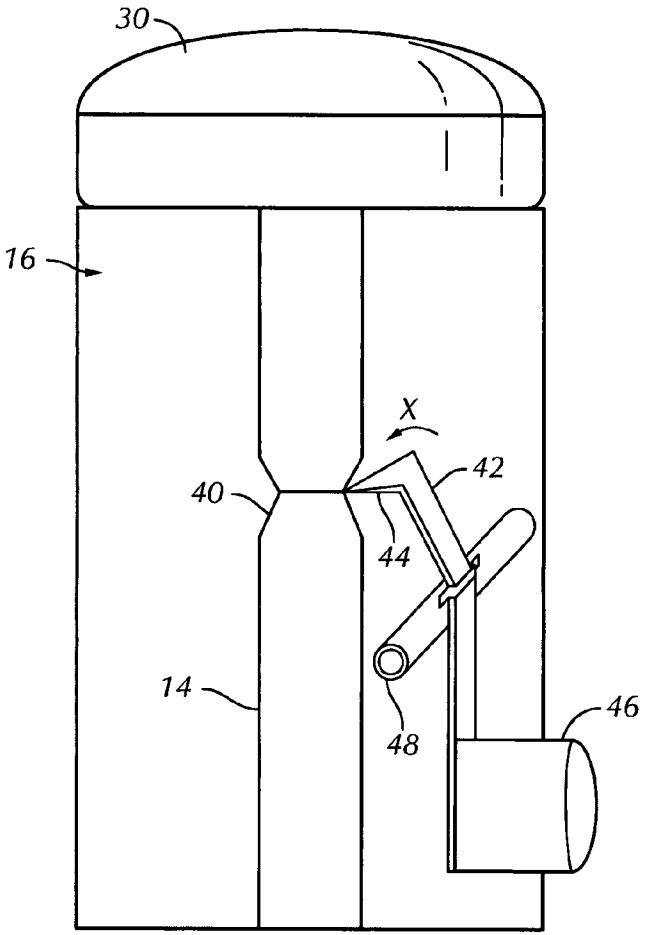
FIG. 4 is an enlarged partial front view of the manual release mechanism engaged upon the antenna in the stowed position depicted in FIG. 1.

FIG. 4 is an enlarged partial front view of the manual release mechanism 20 engaged upon the antenna 14 in the stowed position of FIG. 1. The manual release mechanism provides a mechanism for selectively engaging and releasing the antenna. Preferably, the antenna includes an annular indentation 40. The manual release mechanism may include a rocking arm 42 having an engagement end 44. Upon the opposite side of the rocking arm may be a release button 46. The rocking arm may lie on top of an elevated support structure 49 located on top of a support pin 48. Preferably, the elevated support structure is bendable, allowing the support structure to move from an elevated position to a prone position against the support pin. The support structure is biased in its configuration to remain in the elevated position without the presence of external pressure. The elevated support structure, without any pressure applied to the release button 46 remains in an elevated position which positions the rocking arm and engagement end toward the outer surface of the antenna. However, when pressure is applied to the release button 46, the support structure bends down against the support pin, thereby moving the engagement end away from the outer surface of the antenna. When the release button is released, the support structure returns to its original elevated position, forcing the engagement end against the outer surface of the antenna. The configuration of the rocking arm and support structure 49 upon the support pin enables the rocker arm to drive in direction X as depicted in FIG. 4. The antenna is held in the stowed position by the engagement of the engagement end within the indentation 40. By removing the engagement end 44 from the indentation, the spring 22 is allowed to drive the antenna upward to the extended position. The engagement end is removed from the indentation by depressing the release button 46. The release button is preferably located on the outer surface of the antenna housing.

Figure 5:
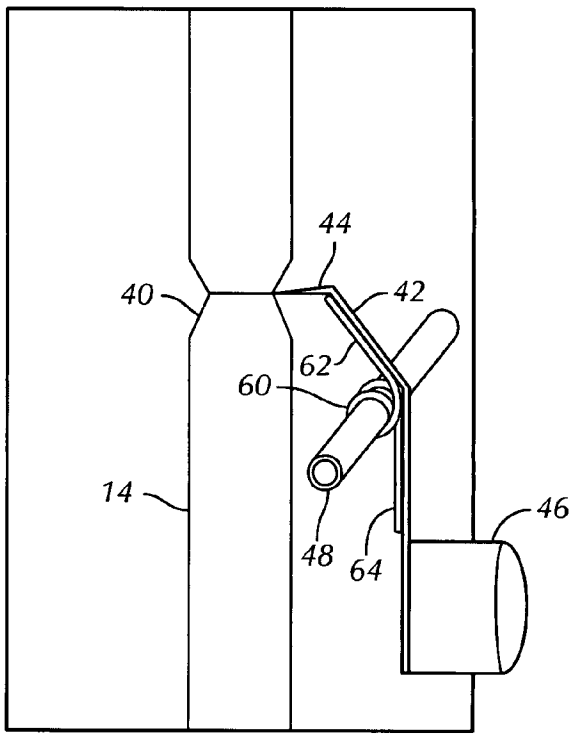
FIG. 5 is an enlarged partial front view of the manual release mechanism engaged upon the antenna in an alternate embodiment of the present invention.

Although the manual release mechanism 20 is depicted in FIGS. 1–3, any device which allows the mobile phone user to manually release the antenna from its stowed position may be used. For example, a spring mechanism may be used to bias the manual release mechanism to release and hold the antenna in the desired position such as depicted in FIG. 5. Alternatively, a rocker switch may be employed. It should be understood by those skilled in the art that any mechanism which allows the manual release of the antenna may be used and still remain within the scope of the present invention.

With reference to FIGS. 1–4, the operation of the present invention will now be explained. In the normal stowed position (FIGS. 1 and 4), the antenna 14 is held within the antenna housing 16. The spring 22 is compressed as shown in FIG. 1 by the washer 32. The antenna is held in place in the stowed position by the engagement of the engagement end 44 within the indentation 40. No action is needed by the mobile phone user to keep the antenna in the stowed position.

If a mobile phone user desires to operate the mobile phone 10, either to originate or answer a phone call, the user may desire to extend the antenna 14. However, with existing mobile phones, the user had to pull the antenna out of the antenna housing 16. In the present invention, the user depresses the release button 46 which forces the elevated support structure 49 to a prone position and allows the rocking arm to pivot about the support pin 48, thereby moving the engagement end 44 away from the indentation 40. Upon removal of the engagement end 44 from the indentation, the spring is allowed to extend to an extended length for which it is naturally biased. The spring drives the washer 32 and the attached antenna upward to the fully extended position. The user may stop depressing the release button 46 at any time after the antenna has been begun driving upward. Upon discontinuing the depression of the release button by the user, the elevated support structure is allowed to return to an elevated position and the rocking arm is again biased to drive the engagement end against the outer surface of the antenna. However, since the engagement end is not engaging the indentation, the antenna is allowed to continue its upward drive to the extended position.

The user may continue to use the mobile phone 10 with the antenna 14 in the extended position without any further action necessary from the user. When the user desires to stow the antenna, the user merely needs to push the antenna downward, preferably by applying a downward force against the antenna cap 30, until the antenna is stowed within the antenna housing 16. As the antenna is pushed down within the housing, the engagement end 44 eventually engages the indentation 40. Upon the engagement of the engagement end within the indentation, the antenna is held in place in the stowed position.

FIG. 5 is an enlarged partial front view of the manual release mechanism engaged upon the antenna 14 in an alternate embodiment of the present invention. To facilitate the bias action of the rocking arm 42, a spring mechanism 60 having arms 62 and 64 may be used. The spring mechanism may be affixed to the support pin 48. The spring mechanism is then configured in such as fashion that the rocking arm is biased by the arms 62 and 64 to a position in which the engagement end 44 contacts the outer surface of the antenna 14. Upon depression of the release button 46, the rocking arm is pivoted away from the antenna. Upon release of the release button, the spring mechanism and associated arms drive the rocking arm toward the antenna, thereby allowing the engagement end 44 to contact the antenna.

The present invention may utilize any spring-loaded configuration for extending the antenna 14. For example, the antenna may be driven upward by any type of spring, not just a coil spring running within the antenna housing 16. The spring may drive a cylinder attached to the antenna, rather than a washer as depicted in FIGS. 1–4.

The antennal extension system 12 may be used to modify any existing portable wireless communication device. The antenna must be removed from the existing antenna housing. A compressible spring is then placed within the bore of the antenna housing. The antenna housing, or a portion of it, may be replaced or modified by adding a manual release mechanism. As discussed above, the release mechanism holds the antenna within the antenna housing when the antenna is in the stowed position. When the manual release mechanism is released, the antenna is driven upward by the compressible spring to an extended position. Rather than modifying the entire housing, the antenna coupling mechanism may be attached to the top of the mobile phone main structure, such as by use of the threaded end 38 to a threaded interior surface of the antenna housing. Alternatively, the existing antenna coupling mechanism may be replaced with an antenna coupling mechanism having a release mechanism. The present invention can therefore easily modify an existing mobile phone with the antenna extension system 12.

The present invention provides many advantages over existing mobile phones. The present invention provides a cost-effective mechanism for manually extending the antenna of a mobile phone. The present invention may be utilized within any mobile phone without limitation to the structure of the mobile phone. For example, the present invention may be used in clamshell type mobile phones as well as the unitary static structure common with many mobile phones. In addition, the present invention does not require the use of any motor or any power, which suffers from the disadvantage of increasing the size and weight of the mobile phone. Additionally, by utilizing motors, precious power stored in mobile phone's battery is lost. In addition, since complicated gearing assemblies are not necessary, the cost and complexity of the phone is reduced. The present invention allows the user to decide when the antenna is extended. In other existing extension systems, the antenna may be automatically extended without regard to the desires of the mobile phone user. The present invention allows the user to manually deploy the antenna with one hand at the user's discretion.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. An antenna extension system for a portable wireless communication device, the extension system comprising:

an antenna housing attachable to the communication device, the antenna housing having a bore;

an antenna slidably positioned within the bore of the antenna housing;

a compressible spring located within the antenna housing; and a manual release mechanism holding the antenna within the antenna housing when the antenna is in the stowed position, the manual release mechanism having means for selectively releasing the antenna;

whereby when the manual release mechanism releases the antenna, the antenna is driven upward by the compressible spring to an extended position.

2. The antenna extension system of claim 1 wherein the spring is located below the antenna at a bottom portion of the antenna housing within the bore.

3. The antenna extension system of claim 1 wherein the antenna includes an attached washer, the spring pushing against the washer.

4. The antenna extension system of claim 1 wherein the manual release mechanism includes a rocker arm having an engagement end for engaging an outer surface of the antenna.

5. The antenna extension system of claim 4 wherein the antenna includes an annular indentation at a position upon the antenna that when the engagement end engages the outer surface of the antenna, the antenna is held in a stowed position.

6. The antenna extension system of claim 1 wherein the manual release mechanism includes a release button located on an exterior surface of the antenna housing, whereby depressing the release button releases the antenna and allows extension of the antenna.

7. The antenna extension system of claim 1 wherein:

the spring is located below the antenna at a bottom portion of the antenna housing within the bore; and the antenna includes an attached washer, the spring pushing against the washer.

8. The antenna extension system of claim 7 wherein:

the manual release mechanism includes a rocker arm having an engagement end for engaging an outer surface of the antenna;

the antenna includes an annular indentation at a position upon the antenna that when the engagement end engages the outer surface of the antenna, the antenna is held in a stowed position; and the manual release mechanism includes a release button located on an exterior surface of the antenna housing, whereby depressing the release button releases the antenna and allows extension of the antenna.

9. An antenna extension system for a portable wireless communication device, the extension system comprising:

an antenna housing attachable to the communication device, the antenna housing having a bore;

an antenna slidably positioned within the bore of the antenna housing;

means for spring-loading the antenna to an extended position; and a manual release mechanism holding the antenna within the antenna housing when the antenna is in the stowed position, the manual release mechanism having means for selectively releasing the antenna;

whereby when the manual release mechanism releases the antenna, the antenna is driven upward by the spring-loaded means to an extended position.

10. The antenna extension system of claim 9 wherein the means for spring-loading the antenna is a spring driving the antenna upward from the antenna housing.

11. The antenna extension system of claim 10 wherein the spring is a compressible coil spring located within the antenna housing.

12. The antenna extension system of claim 9 wherein the manual release mechanism includes a rocker arm having an engagement end for engaging an outer surface of the antenna.

13. The antenna extension system of claim 12 wherein the antenna includes an annular indentation at a position upon the antenna that when the engagement end engages the outer surface of the antenna, the antenna is held in a stowed position.

14. The antenna extension system of claim 9 wherein the manual release mechanism includes a release button located on an exterior surface of the antenna housing, whereby depressing the release button releases the antenna and allows extension of the antenna.

15. A mobile phone having an antenna extension system, the mobile phone comprising:

a mobile phone casing, the mobile phone casing having:

an antenna housing attachable to the mobile phone, the antenna housing having a bore;

an antenna slidably positioned within the bore of the antenna housing;

a compressible spring located within the antenna housing; and a manual release mechanism holding the antenna within the antenna housing when the antenna is in the stowed position, the manual release mechanism having means for selectively releasing the antenna;

whereby when the manual release mechanism releases the antenna, the antenna is driven upward by the compressible spring to an extended position.

16. The antenna extension system of claim 15 wherein the manual release mechanism includes a rocker arm having an engagement end for engaging an outer surface of the antenna.

17. The antenna extension system of claim 16 wherein the antenna includes an annular indentation at a position upon the antenna that when the engagement end engages the outer surface of the antenna, the antenna is held in a stowed position.

18. The antenna extension system of claim 15 wherein the manual release mechanism includes a release button located on an exterior surface of the antenna housing, whereby depressing the release button releases the antenna and allows extension of the antenna.

19. A method of modifying an existing portable wireless communication device, the method comprising the steps of:

removing an antenna from an antenna housing of the communication device;

placing a compressible spring within a bore of the antenna housing;

replacing a portion of the antenna housing with a manual release mechanism; and positioning the antenna within the antenna housing, the manual release mechanism holding the antenna within the antenna housing when the antenna is in the stowed position and the manual release mechanism having means for selectively releasing the antenna whereby when the manual release mechanism releases the antenna, the antenna is driven upward by the compressible spring to an extended position.

20. The method of modifying an existing portable wireless communication device of claim 19 wherein the manual release mechanism includes a rocker arm having an engagement end for engaging an outer surface of the antenna.

* * * * *